United States Patent [19]

Gilmore

[11] Patent Number: 5,051,172

[45] Date of Patent: Sep. 24, 1991

[54] DISC SCREEN FOR MATERIAL SEPARATION

[76] Inventor: Larry J. Gilmore, 17555 SE. Braden, Gladstone, Oreg. 97027

[21] Appl. No.: 431,690

[22] Filed: Nov. 3, 1989

Related U.S. Application Data

[63] Continuation of Ser. No. 141,294, Jan. 5, 1988, abandoned.

[51] Int. Cl.[5] ..... B07B 13/05

[52] U.S. Cl. ..... 209/672; 209/667

[58] Field of Search ..... 209/660, 667, 668, 671, 209/672, 674, 361, 279, 405, 392, 930; 198/382

[56] References Cited

U.S. PATENT DOCUMENTS

| | | | |
|---|---|---|---|
| 622,035 | 3/1899 | Bray | 209/672 X |
| 785,508 | 3/1905 | Mason | 209/672 X |
| 1,524,360 | 1/1925 | Lauritzen | 209/671 |
| 2,055,630 | 9/1936 | McLean | 209/672 X |
| 4,037,723 | 7/1977 | Wahl et al. | 209/672 |
| 4,301,930 | 11/1981 | Smith | 209/672 X |
| 4,658,964 | 4/1987 | Williams | 209/672 X |
| 4,741,444 | 5/1988 | Bielagus | 209/672 |

FOREIGN PATENT DOCUMENTS

| | | | |
|---|---|---|---|
| 574732 | 6/1931 | Fed. Rep. of Germany | 209/672 |
| 553014 | 4/1977 | U.S.S.R. | 209/672 |

*Primary Examiner*—Donald T. Hajec
*Attorney, Agent, or Firm*—Robert L. Harrington

[57] ABSTRACT

A disc screen having rows of rotatable discs separated by sleeve-like spacers. Discs of adjacent rows are offset and extended to a near touching relationship with the spacers of adjacent disc rows. A supporting and rotatably driven shaft extended through each row of disc and spacers. The spacers are independently mounted to the shaft with internal strengthening gussets having keyway-type openings slidably fitted to the shaft's non-circular cross section. End discs on each shaft are mounted for close proximity to the side rails of the disc screen housing and, as aligned along the side rails, are reduced in diameter to prevent interference. The proximity of the end discs to the side rails prevent materials from being jammed against the side rails.

4 Claims, 2 Drawing Sheets

FIG. 1
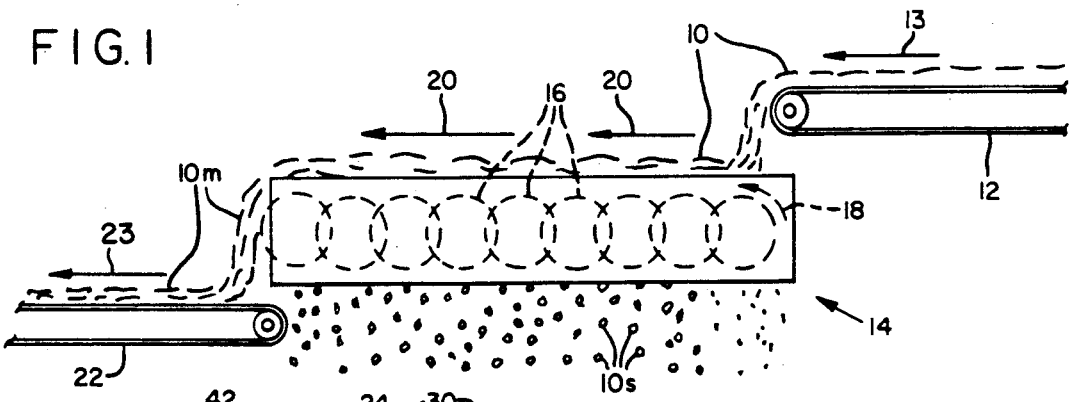
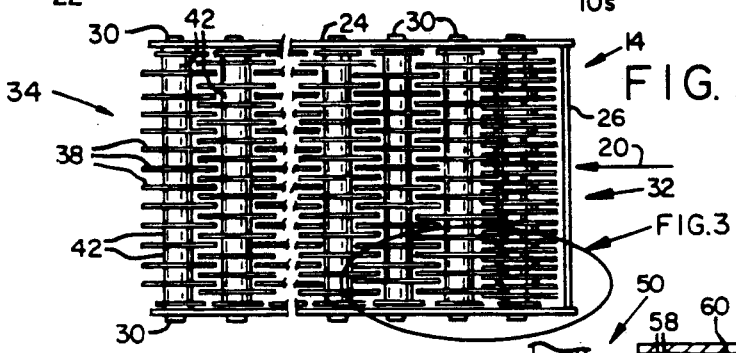
FIG. 2
FIG. 3
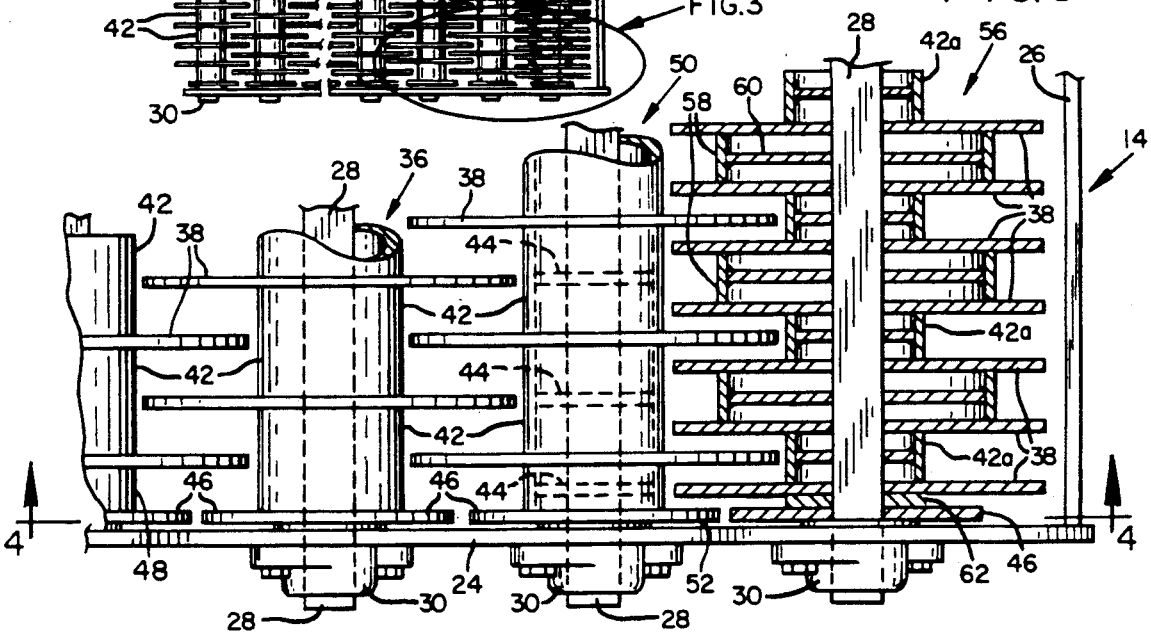
FIG. 4
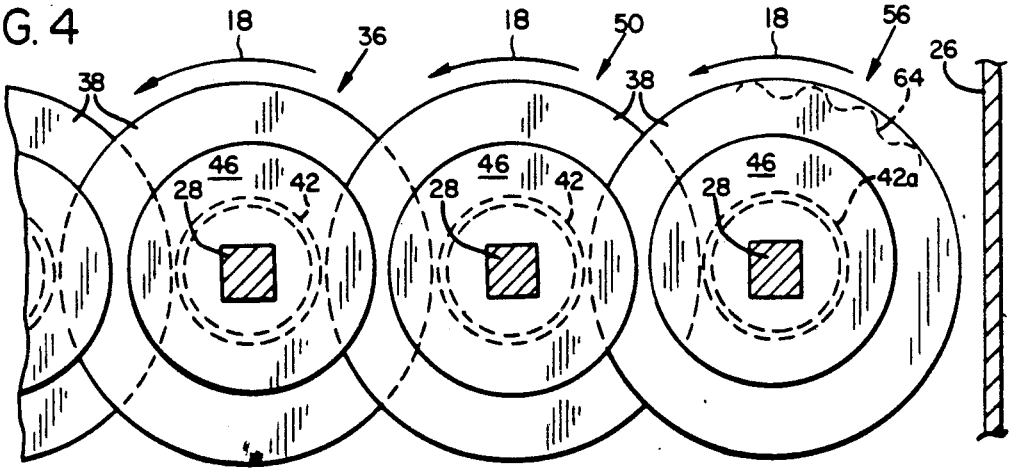

DISC SCREEN FOR MATERIAL SEPARATION

This is a continuation of co-pending application Ser. No. 141,294, filed on 1/5/88 now abandoned.

FIELD OF INVENTION

This invention relates to a separating apparatus for separating an admixture of materials by size, and more particularly to improvements in a disc screen that improves performance and reduces maintenance thereof.

BACKGROUND OF THE INVENTION

Disc screens as contemplated by the present invention are frequently used as one stage of a multi-stage materials separating system. Such a multi-stage system is illustrated in co-pending application, Ser. No. 841,168. FIG. 9 is a plan view of the disc screen which is also indicated by reference 56 in FIG. 1. Whereas the illustrated system is designed to separate out an intermixture of such debris as wood, rock and dirt accumulated in a lumber mill yard, the disc screen has further application for separation of refuse and all manner of materials where separation by size is an objective.

In general, the discs of a disc screen are mounted on shafts at spaced positions along the length of the shaft thereby forming disc rows. The shafts or disc rows are mounted in parallel with the discs of one disc row interspersed between the discs of adjacent (before and after) disc rows. Rectangular openings are formed by the spacing between the adjacent overlapping discs of adjacent disc rows in one dimension and by the spacing between adjacent shafts in the other dimension. Materials passing through the disc screen have to fit down through these openings.

The discs are rotated on the shaft in a direction from an inlet end to an outlet end. An admixture deposited on the inlet end of the disc screen will be rolled by the discs toward the outlet end with materials of the acceptable size passing through the screen and the rejected materials being rolled toward and off the outlet end of the screen.

Problems encountered by such disc screens, which are the object of the present invention, are twofold. Materials in such admixtures come in all manner of sizes, shapes and consistencies, i.e. they can be rock hard or paper soft. As the materials are rolled off one row of discs and onto another, there is a tendency for certain of the materials, i.e. those that are just oversized for the screen opening, to become lodged between the rows. The edges of certain of the discs are sometimes scalloped or lobed to assist in gripping and moving the materials along the rows. At any rate, the problem is not particularly significant except at the ends of the disc rows. If material becomes lodged between a last disc in the row and the sidewall of the screen housing, it can become jammed. Unjamming may require shutting the operation down and manually removing the jammed materials.

As concerns the second problem; the shaft-to-shaft dimension as described above as one of the dimensions for the screen openings, is actually made up of sleeve sections that surround an inner driven shaft. The sleeve sections also separate and space the discs along the shaft length. Previously, these sleeve sections were supported on the shafts by rails running along the length of the shaft welded directly to the discs. The problem encountered with this structure is that any deformity of the discs (as when occasionally a disc is severely struck by a rock-hard object) would skew the sleeve section and create an interference between the close fitting sleeve sections and the aligned discs of the adjacent rows of discs.

BRIEF DESCRIPTION OF THE INVENTION

The problem of jamming at the shaft ends has been largely eliminated by the provision of end discs that are placed adjacent the sidewall or even recessed slightly into the sidewall to prevent materials from entering between the end disc and side wall. Because the end discs will be aligned as between adjacent shafts, they are reduced in diameter as compared to the interspersed discs.

The problem of skewing the disc spacers is largely eliminated by providing the spacers or sleeve sections as separate elements. The sleeve sections typically have a greater inside diameter than the inner shaft and thus an interior gusset is provided as a strengthening rib for the sleeve section. The gusset is fit to the inner shaft in the same manner as the disc and rotates with the disc. The gusset-strengthened sleeve section not only is unaffected by damage to the disc, even in instances when the sleeve sections are directly impacted, these strengthening gussets resist deformation of the sleeve section.

The invention will be more fully appreciated by reference to the following detailed description and drawings.

BRIEF DESCRIPTION OF THE DRAWINGS

FIG. 1 is schematic side view illustrating a screening disc of the present invention in operation;

FIG. 2 is a schematic top view of the screening disc of FIG. 1;

FIG. 3 is an enlarged view of a corner portion of the disc screen as if including an area such as encircled IN FIG. 2;

FIG. 4 is a view as taken on view lines 4—4 of FIG. 3;

DETAILED DESCRIPTION

Figure 5:
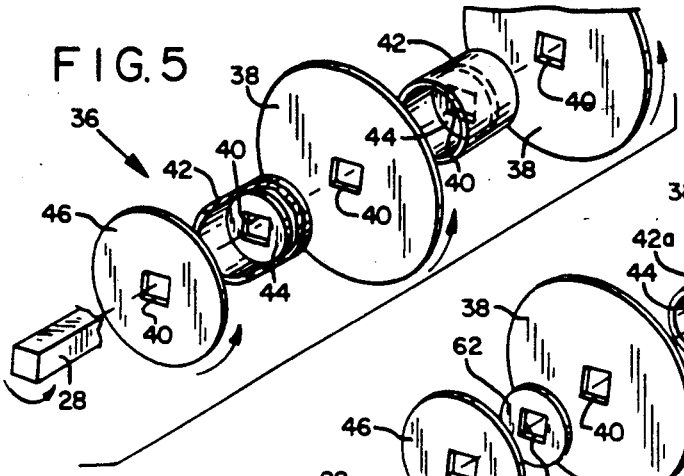
FIG. 5 is an exploded perspective view illustrating the arrangement of discs and spacers of certain of the rows of discs, e.g. the third row right-to-left as illustrated in FIG. 3.

Referring to FIG. 1, an admixture of material 10 is conveyed by a conveyor 12 (see arrow 13) and deposited on a disc screen 14, including rotating discs 16 rotating in a counterclockwise direction as indicated by arrow 18. The rotating discs move the admixture 10 along the length of the disc screen as indicated by arrow 20. The smaller size materials 10*s* of the admixture 10 drop through the screen (between the discs) and the larger size materials 10*m* are conveyed by the discs 16 to be directed off the disc screen and onto a second conveyor 22 (arrow 23) or other processing components.

A plan view of the disc screen is illustrated in FIG. 2 and arrow 20 indicates the direction of movement of the admixture (not shown) along the disc screen. FIG. 3 which is an enlarged view of the lower right-hand corner of FIG. 2 (as indicated), and FIG. 4, which is a side view of the FIG. 3 apparatus (as indicated by view lines 4—4), illustrate in detail the features comprising the present invention. The exploded perspective view of FIGS. 5 and 6 will also aid the reader in understanding these features.

The disc screen frame includes side rails 24 and end rails 26. A plurality of shafts 28 are rotatably mounted in bearings 30 at the side rails 24. In a specific example of a disc screen that was produced and which will be referred to in setting forth dimensions hereafter, the screen was made six-feet wide and ten-feet long with nine shafts 28 mounted in parallel arrangment at one-foot centers along the disc screen length. The two end shafts were mounted one-half foot inwardly from each end.

The disc screen, as illustrated, has an inlet end 32 and an outlet end 34 (see FIG. 2), the difference being the initial disc and spacer arrangement on the first row of discs (on the first shaft 28) at the inlet end of the screen, which is the far right shaft shown in FIGS. 1,2,3 and 4. Not shown is a slope sheet which is commonly utilized for delivery of the materials onto the disc screen but, which is not shown herein. It is considered unnecessary for an understanding of the invention. The arrangement of the first disc row is specifically illustrated in FIG. 6. It is not a necessary arrangement for the invention, and thus the more typical arrangement of the other rows will be explained first. However, the reader should understand that this first row has a definite benefit and in certain circumstances, two or more of the "first" rows may be provided with this "closed-in" arrangement which will be more specifically described in a later section.

Reference is made to the third row of discs which is duplicated at alternate row positions, i.e. the third, fifth, seventh and ninth rows are the same. Arrow 36 indicates this third row in FIG. 3. This arrangement is specifically illustrated in the exploded view of FIG. 5. Discs 38 are provided with centered square holes 40 that are sized to fit the cross section of shaft 28 and thereby key 5 the discs to the shaft. The shaft 28 is consistently dimensioned along its length so that the disc 38 is free to slide on the shaft 28. There are a total of twelve discs 38 spaced along the length at five-inch intervals. The positions of the discs on the shaft are affixed by spacers.

The spacers in the form of sleeve sections 42 between the discs 38 have a five-inch length and surround the shaft 28 as illustrated. Each sleeve section 42 has an inner diameter greater than the cross section of shaft 28 and is fitted with an internal gusset 44, welded in place in the sleeve section and provided with a square-shaped opening 40 like that of the discs 38. The spacers or sleeve sections 42 are similarly free to slide along shafts 28. Disc 46 to be later explained in more detail, is provided at each end of shaft 28 and is also provided with square-shaped openings 40.

The arrangement of the even numbered rows (the second, fourth, sixth and eighth rows) are similar to that of row 36 except that the spacing sleeve section 48 between the end disc 46 and the first full-sized disc 38 is shortened as compared to spacer 42 to position the discs 38 thereafter intermediate of the disc positions on the rows 36, i.e. they are interspersed to allow overlapping of discs in adjacent rows. The length of these end spacers 48 are about one-half or slightly less than half the length of spacers 42 (i.e., whatever is required to position the discs along the shaft length at about the mid-point of the positions of the discs in alternating rows, three, five, seven and nine). The end sleeve sections or shortened spacers 48 are similarly provided with strengthening or stiffening gussets 44 (shown in dash lines in row two, row two being indicated by reference number 50 in FIG. 3).

As will be obvious from reference to FIG. 3, the end discs 46 are substantially smaller in diameter than discs 38. This is because rather than being offset in adjacent disc rows, the discs 46 are positioned in close proximity, e.g. tight up against the straight side rail 24 and, consequently, in alignment one with the other. The shafts 28 are on one-foot centers and thus the maximum diameter permitted for the discs 46 is about one foot. Of course, some clearance is desirable and a one-fourth to one-half inch space between the discs is suggested, making the discs approximately eleven and three-fourths to eleven and seven-eights inches in diameter.

The smaller discs 46 do not match up with adjacent discs 38 positioned inwardly on the same shaft because of the difference in diameter, notably they are mismatched in height as apparent by reference to FIG. 4. The disc 46 is, however, positioned tight against the bearing 30 so as to maintain minimum clearance 52 with the side rail. Materials are prevented by the end disc 46 and the adjacent or mated disc 38 function to effectively lift and move materials that would likely cause jamming in the prior disc screen apparatus.

Figure 7:
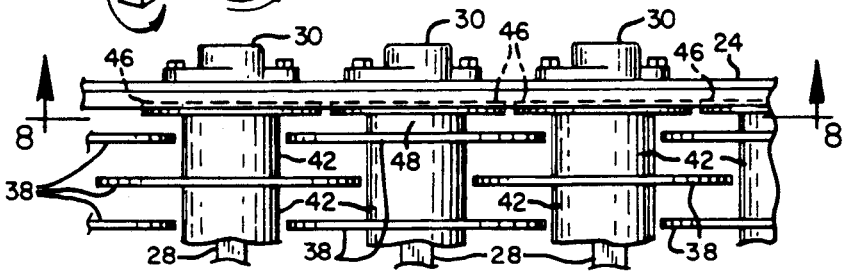
FIGS. 7–10 are alternate embodiments of the disc screen.
Figure 8:
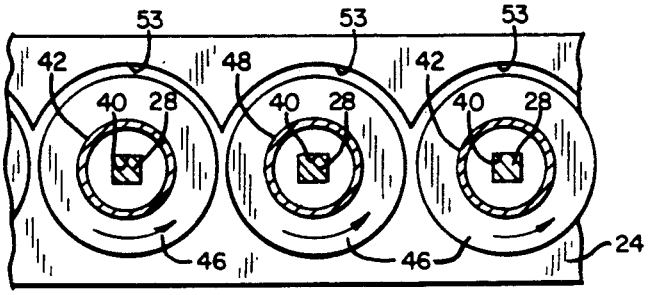

Alternate forms of the end disc feature are available, examples of which are illustrated in FIGS. 7 and 8. FIGS. 7 and 8 are top and side views showing the discs 46 set into recesses 53 so as to be partially recessed in the side rail 24. Insetting the discs avoids clearance 52 between the rail 24 and disc 46 (see FIG. 3).

Figure 9:
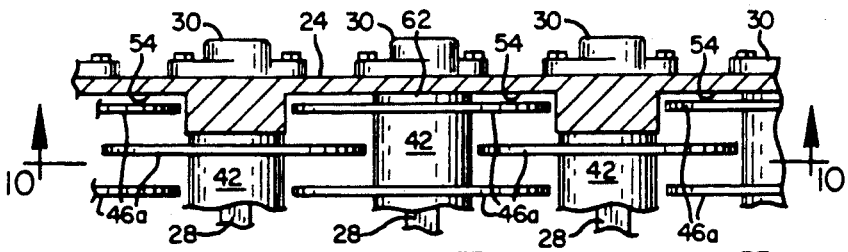
Figure 10:
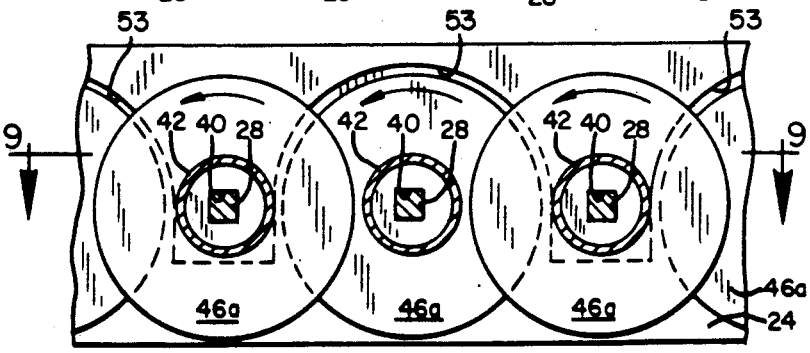

FIGS. 9 and 10 illustrates an ambodiment where the side rail 24 is configured to permit alternating overlapping larger end discs 46*a*, i.e. which are the same dimensions as discs 38. Whereas such variations of disc arrangements have been tried, they have not been found to provide the benefits of the smaller in-line discs of the present invention.

Reference is now made to the first row indicated by arrow 56 in FIG. 3. This first row disc-spacer arrangement is unique in the disc screen. The reason is that this first row does not have an adjacent disc row on the inlet side in that it is placed adjacent front end rail 26. In a typical disc-spacer arrangement like row 36, with the interspersed discs of an adjacent row of discs, the screen hole opening is less than two and one-half inches. In row 56, however, at the inlet side of the shaft 28, that same spacing is determined by the spacing between the discs 38 on the same shaft. If the arrangement of this row were similar to that of the third row, the disc screen openings at that inlet side would be up to five inches. Note that the problem doesn't exist at the outlet end row (see FIGS. 1 and 2) because the end rail fits under the last row of discs. Material carried along by the rotating discs simply is rolled over the end rail onto the conveyor 22.

Figure 6:
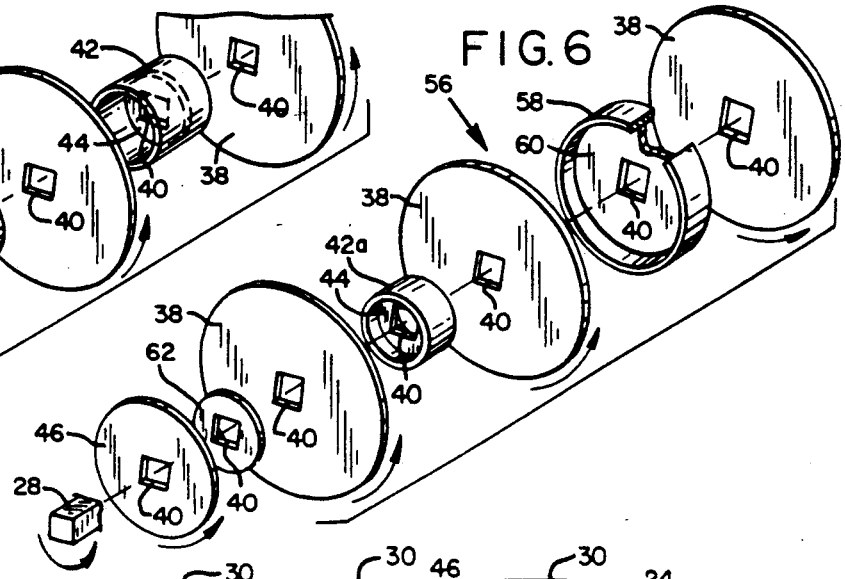
FIG. 6 is an exploded perspective view illustrating the arrangement of discs and spacers of the first row of FIG. 3.

The normal five-inch spacing between discs 38 is modified for the first row 56 as illustrated in FIGS. 3 and 6. At the position where typically a disc 38 is provided for row three i.e. aligned with spacer 42 of row two, in row one a pair of discs 38 are provided. Thus, the number of discs 38 are doubled for end shaft 28. However, the one-half inch disc thickness by itself is not sufficient to fill in the two and one-half inch extra gap created by the missing interspersed discs of an adjacent row. Thus the paired discs 38 are separated by an additional spacer 58. Spacer 58 similarly includes a gusset 60 (enlarged over that of gussets 44) which is provided with the same center opening 40. Between the paired discs 38 is provided a shortened spacer sleeve 42*a*, which, except for being shortened, functions like the spacers 42 of the previously described rows of discs (and is very close to if not the same as the length of spacers 48).

The reader will thus appreciate the arrangement of the nine rows as follows. For the first row (reference 56), shaft 28 is fitted with an end disc 46, a spacing washer 62 and a single disc 38. This arrangement sets up the appropriate interspersing of the double disc configuration between discs 38 in row two. Thus, in alternating fashion thereafter, a short spacer 42*a* is followed by a composite of a disc 38, a spacer 58, and a second disc 38, (referred to as as doubledisc arrangement), followed again by a spacer 42*a*, followed by a double disc arrangement, and so on. At the opposite end, the start-up sequence previously described is repeated including an end disc 46, washer 62 and single disc 38.

The second, fourth, sixth and eighth rows are as indicated in FIG. 3, with an end disc 46 followed by a shortened spacer 48 (similar to that of 42*a*), followed in alternating fashion by discs 38 and spacers 44. Again, the opposite end is similar with the end disc 46 being preceded by the shortened spacer 48. The rows three, five, seven and nine are a slight variation to that of rows two, four, six and eight, in that the end discs 46 are immediately followed by alternating ones of the spacers and discs. It should be noted that row one has a total of twenty-six discs, rows two, four, six and eight each have thirteen discs, and rows three, five, seven and nine each have twelve discs.

The various dimensions and sizes set forth can, of course, vary. The referred to disc screen that was constructed in accordance with this invention (many of the dimensions and specific features thereof having been previously described) included discs 38 having a one-half inch thickness and a seventeen-inch outside diameter. The discs were spaced five inches apart along the same row and two and one-half inches apart from an interspersed disc. The spacer 42 have a wall thickness (for rigidity) of five-eighths inch thick with a six and three-fourths inch outside diameter. The shafts 28 were placed on one-foot centers so that the spacing between the outer edges of discs 38 and the outside walls of spacers 42 on adjacent rows was less than one-fourth inch whereby in rotation the discs 38 pass in close proximity to spacer 42. Certain of the discs 38 were provided with lobes 64 (shown in dash lines in FIG. 4) as by scalloping to facilitate movement of the material along the disc screen.

The smaller spacers 42*a* and larger spacers 58 for the first row 56 were two and one-half inches in length (the larger spacers 58 having a twelve and three-fourths inch diameter). The cross section of the shaft 28, and accordingly the hole 40 provided through the gussets and the discs, was approximately a square shape of four inches to a side.

The invention herein described is believed to solve significant problems that have long existed for disc screens previously in use and operation. Damage to the improved discs is less likely and when damage occurs, it is far less serious. Because the discs and spacers are independently mounted to the shaft, damage is less likely because even though a disc 38 may become damaged, that damage will not likely distort the adjacent spacers, as was often the case previously. Any distortion of the spacers places the discs 38 before and after it in jeopardy of also being damaged.

The disc screen reduces downtime by significantly reducing the likelihood of jamming along the side rails. This feature and the feature of the spacers are believed novel and those skilled in the art will readily appreciate the advantages that are provided and the application of these features to disc screens in general.

The structure of the disc screen has been somewhat simplified to avoid unnecessary complexity. Those skilled in the art will appreciate that the supporting frame around the disc rows typically involves the use of side sheets and bearing shields to facilitate maintenance and adjustment. In all cases, however, some form of side wall, like rail 24, is present and the application of the inventive feature for avoiding side wall jamming applies in the manner described. The invention is considered to encompass all these and similar variations in kind as determined by the applicable scope of the claims appended hereto.

What I claim is:

1. A materials, size separating apparatus comprising; a disc screen having side and end rails, shafts extended between the side rails and rotatably mounted on the side rails for rotation in a common rotative direction, each shaft provided with alternating discs and sleeve section spacers forming disc rows that are rotated with the shaft to induce movement of the materials from one end to the other on the disc screen, therby defining an inlet end and an outlet end for said disc screen, the shafts fitted with the alternating discs and sleeve section spacers that affix the positions of the discs along the shaft length, and adjacent disc rows arranged to alternate the positions of the discs along the shaft so that the discs of one disc row are interspersed between the discs of an adjacent disc row and in rotation pass in close proximity to the sleeve section spacers of said adjacent dis row, and each of said disc rows provided with an end disc in close proximity to the side rail of the disc screen, the side rails being recessed to accommodate the end discs with the end discs partially recessed into the side rails and partially extended from the recesses and side rails to eliminate any clearance for jamming of materials against the side rails.

2. A materials, size separating apparatus comprising; a disc screen having side and end rails, shafts extended between the side rails and rotatably mounted in the side rails for rotation in a common rotative direction, each shaft provided with disc rows that are rotated with the shafts to induce movement of materials from one end of the disc screen to the other end thereof and defining thereby an inlet end and an outlet end, said disc rows comprising the shafts fitted with alternating non-connected, independently supported discs having lobed peripheries and independently supported sleeve section spacers that are in abutment with the discs along the shaft length to affix the positions of the discs in the disc rows, and adjacent disc rows arranged to alternate the positions of the discs in the disc rows so that the discs of one disc row are interspersed between the discs of adjacent disc rows, said adjacent disc rows being positioned so that the discs of adjacent disc rows overlap and during rotation pass in close proximity to the sleeve section spacers of adjacent disc rows aligned with the discs, the disc row at the inlet end provided with arrangements of paired discs aligned with the sleeve section spacers of the adjacent disc row, said arrangements including spacers between the paired discs to reduce the spacings around the disc pairs of said disc row at the inlet end and thereby avoid enlarged screen openings as between the disc row and the end rail of the disc screen.

3. A materials, size separating apparatus for separating refuse materials, said apparatus comprising; a disc screen having side and end rails, shafts spanning the spacing between the side rails and rotatably mounted on the side rails for rotation in a common rotative direction, each shaft configured to slidingly receive alternating discs and sleeve section spacers forming disc rows that are rotated with the shaft to induce movement of the materials from one end to the other on the disc screen, and adjacent disc rows arranged to alternate the positions of the discs along the shaft so that the discs of one disc row are interspersed between the discs of an adjacent disc row, said adjacent disc rows being positioned so that outer disc portions of adjacent disc rows overlap and in rotation pass in close proximity to the sleeve section spacers of said adjacent disc rows, and the improvement which comprises;

each of said disc rows provided with a flat end disc slidingly positioned on and rotatable with the configured shaft, said flat end disc being shaped and in close proximity to the side rail of the disc screen housing while maintaining a minimum clearance therewith to, together with the adjacent disc along the disc row, lift and move the materials thereby inhibiting the jamming and collection of the refuse materials against the side rails, said end discs in alignment and nonoverlapping and thus of smaller diameter than the interspersed discs.

4. A materials, size separating apparatus as defined in claim 3 wherein said sleeve section spacers are independent of said discs and independently supported on said shaft, said sleeve section spacers having an inside diameter greater than said shaft, and a rigid supporting gusset providing a strengthening rib inside the sleeve section spacers, said discs and gussets having shaft receiving openings for sliding engagement on said shaft with alternating discs and spacers arranged across the entire shaft length to affix the positions thereof in the disc rows, and said discs being keyed to the shaft for rotation therewith.

* * * * *